US011898334B2

(12) United States Patent
Ross et al.

(10) Patent No.: US 11,898,334 B2
(45) Date of Patent: Feb. 13, 2024

(54) MOUNTING DEVICE AND INSTALLATION ARRANGEMENT

(71) Applicant: Uponor Innovation AB, Virsbo (SE)

(72) Inventors: Andreas Ross, Haßfurt (DE); Paul Bartenstein, Westhausen (DE)

(73) Assignee: Uponor Innovation AB, Virsbo (SE)

( * ) Notice: Subject to any disclaimer, the term of this patent is extended or adjusted under 35 U.S.C. 154(b) by 0 days.

(21) Appl. No.: 17/739,057

(22) Filed: May 6, 2022

(65) Prior Publication Data

US 2022/0356683 A1 Nov. 10, 2022

(30) Foreign Application Priority Data

May 7, 2021 (DE) ..... 202021102490.9

(51) Int. Cl.

| | |
|---|---|
| ***E03B 7/09*** | (2006.01) |
| ***E03C 1/02*** | (2006.01) |
| ***E03C 1/10*** | (2006.01) |

(52) U.S. Cl.

CPC ..... *E03C 1/021* (2013.01); *E03B 7/095* (2013.01); *E03C 1/10* (2013.01); *Y10T 137/698* (2015.04)

(58) Field of Classification Search

CPC ..... E03B 7/095; E04F 19/08; Y10T 137/698
USPC ..... 220/3.2–3.8, 366.1
See application file for complete search history.

(56) References Cited

U.S. PATENT DOCUMENTS

| | | | | |
|---|---|---|---|---|
| 4,102,475 A * | 7/1978 | Kalvaitis | H02B 1/28 | 220/366.1 |
| 4,564,249 A * | 1/1986 | Logsdon | E03C 1/021 | 312/229 |
| 8,217,262 B2 * | 7/2012 | Lank | A47G 1/06 | 174/480 |

FOREIGN PATENT DOCUMENTS

| | | | |
|---|---|---|---|
| DE | 1823066 | U | 12/1960 |
| DE | 2262228 | A1 | 6/1974 |
| DE | 9302695 | U1 | 5/1993 |
| DE | 4244578 | A1 | 7/1994 |
| DE | 4338310 | A1 | 5/1995 |
| DE | 29618596 | U1 | 12/1996 |
| ES | 1070845 | U | 11/2009 |
| GB | 2536652 | A | 9/2016 |
| GB | 2546778 | A | 8/2017 |
| IT | 201900018950 | A1 | 4/2021 |

* cited by examiner

*Primary Examiner* — Kevin F Murphy
(74) *Attorney, Agent, or Firm* — Haynes Beffel & Wolfeld LLP; Andrew L. Dunlap; Jason Liao

(57) ABSTRACT

A mounting device and installation arrangement is provided. The mounting device can be for a water station and can include a mounting frame for attachment to a wall surrounding an opening and can further include a cover for closing the opening. Additionally, a ventilation slot can be provided between the mounting frame and the cover in a closed state for an air flow between the cover and the mounting frame.

10 Claims, 2 Drawing Sheets

MOUNTING DEVICE AND INSTALLATION ARRANGEMENT

RELATED APPLICATIONS

This application claims priority to German application No. 202021102490.9, filed May 7, 2021, which is incorporated by reference herein.

BACKGROUND

A mounting device for a water station is specified, in particular for a fresh water station, an residential transfer station and/or a decentralized drinking water heating station. Furthermore, an installation arrangement for a water installation is specified.

Water stations are used in building services to distribute and, if necessary, heat water to individual consumers such as showers or faucets.

It is desirable to disclose a water station mounting arrangement that is reliably operable. It is also desirable to disclose an installation arrangement that is reliably operable.

SUMMARY OF THE INVENTION

Embodiments relate to a mounting device for a water station. The water station is, for example, a fresh water station. Alternatively or additionally, the water station is, for example, a residential transfer station. Alternatively or additionally, the water station is, for example, a decentralized drinking water heating station. In particular, the mounting device is part of the elements used to attach the water station to a wall or other building element or other background. The mounting device has a mounting frame. The mounting frame is used for attachment to a wall. The mounting frame surrounds an opening. The mounting device has a lid. The lid is designed to close the opening. For example, the cover is designed to be movable relative to the mounting frame so that the opening can be selectively opened or closed.

A ventilation slot is provided between the mounting frame and the lid in a closed state. The ventilation slot is designed to allow air flow between the lid and the mounting frame. In the closed state, the lid is coupled to the mounting frame and closes the opening. Only the ventilation slot is free so that the air flow can circulate between the lid and the mounting frame.

By means of the air flow, it is possible that heat generated inside the mounting frame during operation can be dissipated out of the mounting frame into the environment despite the closed lid. This prevents heat buildup inside the mounting frame. A temperature increase inside the mounting frame above an intended maximum temperature can be avoided. In particular, this prevents cold water from heating up excessively. Thus, the mounting device enables reliable operation of a water station, since both heating of water is made possible and a reduction of unintentional heating of cold water is achieved.

According to at least one embodiment, the lid has two longitudinal sides and two transverse sides. In particular, the lid is formed in a rectangular shape. The ventilation slot is formed on the two longitudinal sides and on the two transverse sides in each case between the lid and the mounting frame. It is also possible that the ventilation slot is formed only on one, on two or on three of the two longitudinal sides and two transverse sides. For example, the ventilation slot is only provided on the two transverse sides so that warm air can escape through the ventilation slot by means of an upward air flow and air can flow in through the ventilation slot on the lower transverse side.

According to at least one embodiment, the ventilation slot has a width. The width is different along the circumference of the lid, for example. It is also possible that the width along the circumference of the lid is the same and unchanged. For example, the width is chosen to be different so that it is larger at areas where a greater exchange of air is to take place. For example, the ventilation slot is wider at the top and bottom of the transverse sides than at the sides of the longitudinal sides.

According to at least one embodiment, the mounting frame has at least a first and a second mounting projection. The cover can be fastened to the mounting frame at the mounting projections. The ventilation slot is formed between the mounting projections. The mounting projections provide a mounting interface by means of which the lid can be attached to the mounting frame, for example, by means of screws, hinges or otherwise formed connections. Outside the mounting projections, the lid is spaced apart from the mounting frame in particular so that the ventilation slot is formed.

According to at least one embodiment, the lid is free of ventilation slots. In particular, the lid is formed continuously, for example from a metal sheet or a plastic, and itself has no interruptions that are intended to serve for ventilation. The ventilation of the assembly device is sufficiently realized by the ventilation slot.

According to one embodiment, an installation arrangement for a water installation comprises a mounting device according to one of the embodiments described herein. The installation arrangement comprises a water station, for example a fresh water station, a residential transfer station and/or a decentralized drinking water heating station. The water station is arranged in the installation arrangement. The water station can be covered by means of the cover, so that in operation heat from the water station can be discharged with the ventilation flow from the mounting device. The water station is arranged in a wall by means of the mounting device, for example, and can be coupled to water pipes. Waste heat generated by the water station during operation is dissipated from the mounting device through the ventilation slot, so that within the mounting device the water station is not excessively heated at undesirable locations. In particular, this prevents the water station in the mounting device from being undesirably excessively heated at the points where cold water is to be fed.

It is possible that the installation arrangement has further elements arranged and mounted in the mounting device. For example, the water installation also has a distribution system for underfloor heating, which is arranged in the mounting device in addition to the water station.

According to at least one embodiment, the water station has a cold water side and a hot water side. During operation, the hot water side is coupled to a hot water storage tank, for example via a heat exchanger. The ventilation slot is configured such that, in operation, heat is removed from the hot water side with the ventilation flow and is conducted away from the cold water side. Heat that occurs on the hot water side is kept away from the cold water side as far as possible and dissipated before the heat can heat the cold water side excessively.

The installation arrangement thus allows reliable operation of the water station and, if necessary, other elements of the water installation, avoiding excessive interference between the different temperature ranges, since the air flow and the ventilation slot are designed for sufficient dissipation of waste heat.

Further advantages, features and further developments result from the following examples explained in connection with the FIGS. Identical, similar and similar-acting elements can be provided with the same reference signs across the FIGS.

DETAILED DESCRIPTION

Figure 1:
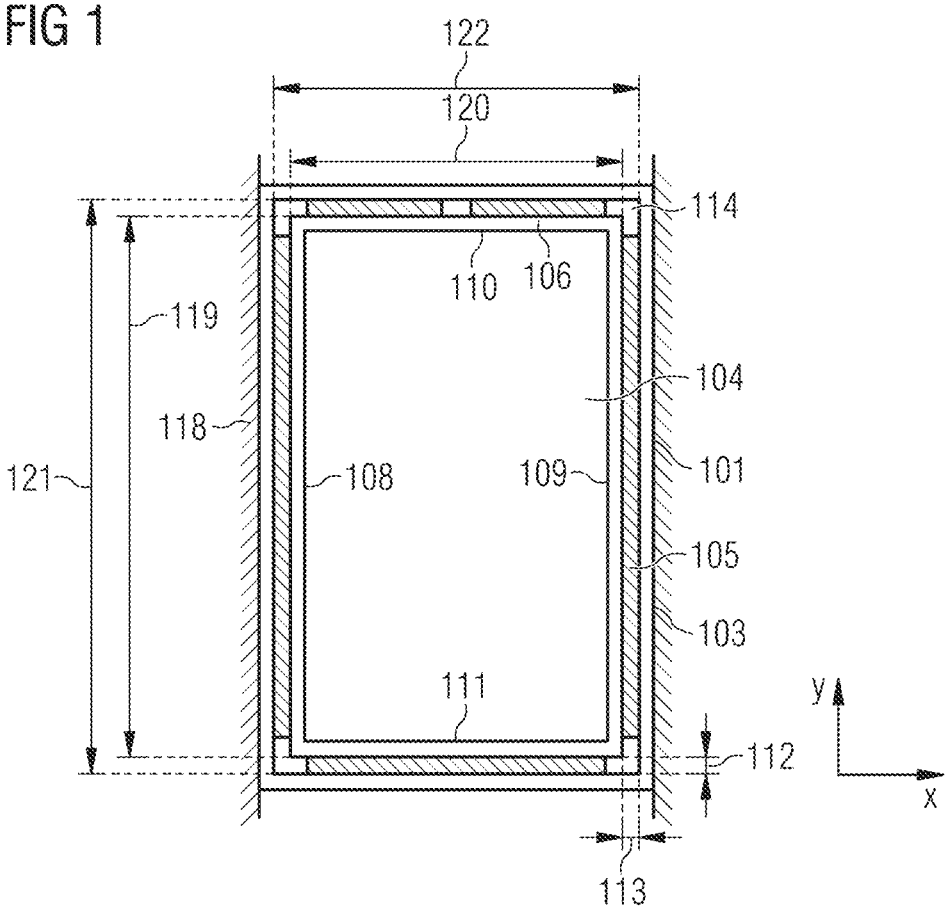
FIG. 1 a schematic representation of an assembly device according to an embodiment, FIG. 2 a schematic representation of a mounting frame according to an embodiment, FIG. 3 a schematic representation of a mounting frame and a water installation according to an embodiment, and FIG. 4 a schematic representation of an installation arrangement according to an embodiment.
Figure 3:
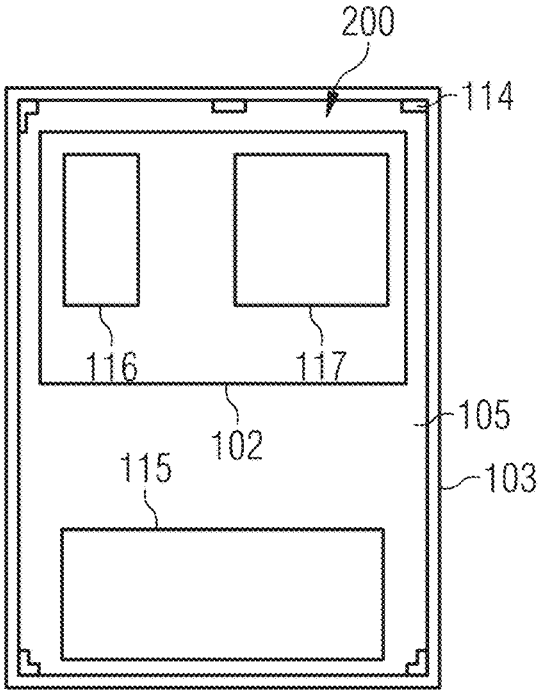

FIG. 1 shows a schematic representation of a mounting device 101. The mounting device 101 is used, for example, for mounting a water installation 200 (FIG. 3). By means of the mounting device 101, the water installation 200 can be mounted, for example, in a building, in particular in a wall 118.

The mounting device 101 has a mounting frame 103. The mounting frame surrounds an opening 105. By means of the opening 105, the water installation 200 is accessible during operation. The water installation 200 is arranged, for example, in the opening 105 of the frame 103. The mounting frame 103 is connected to the wall 118, for example, and is inserted into a recess 118. The mounting frame 103 may have further apertures or recesses through which lines, pipes and other elements can be guided into the interior of the mounting frame 103.

The mounting device 101 has a lid 104. The lid 104 is used to close the opening 105. The lid 104 is insertable into the mounting frame 103 to substantially close the opening 105 in a closed state. For example, the lid is movable relative to the mounting frame 103 to provide access to the interior of the mounting frame 103.

The mounting frame 103 has mounting projections 114. The mounting projections 114 project in the direction of the center. The cover 104 is coupleable to the mounting frame 103 at the mounting projections 114. The cover 104 is attachable to the mounting protrusions 114. The cover 104 is in contact with the mounting frame 103 at the mounting protrusions 114.

Outside of the mounting protrusions 114, the cover 104 and the mounting frame 103 are spaced apart so that ventilation slot 106 is formed. Ventilation slot 106 is formed between cover 104 and mounting frame 103.

Along a first direction X, the lid 104 has two transverse sides 110, 111. Along a second direction Y, the lid has two longitudinal sides 108, 109. The X direction and the Y direction are aligned in particular perpendicular to one another. Along the longitudinal sides 108, 109 and along the transverse sides 110, 111, the lid 104 has a longer extension in each case than transversely to the longitudinal sides 108, 109 and the transverse sides 110, 111. The lid 104 thus has its main extension in the XY plane.

Along the longitudinal sides 108, 109, the lid has an extension 119 along the Y direction. Along the transverse sides 110, 111, the lid 104 has an extension 120 along the X direction. The mounting frame 103 surrounds the opening 105 such that, with the exception of the mounting protrusions 114, an inner side of the mounting frame 103 has a length 121 along the Y direction. Comparably, the mounting frame 103 has a length 122 on the inner side along the X direction. The extension 119 is less than the length 121. The extension 120 is less than the length 122.

Thus, the lid is spaced apart from the mounting frame 103 outside of the mounting protrusions 114. The distance between the mounting frame 103 and the lid 104 forms the vent slot 106, which is formed between the mounting protrusions 114. The ventilation slot 106 is large enough to allow airflow 107 (FIG. 4) to conduct heat from the interior of the mounting device 101 to the exterior during operation.

The vent slot 106 has a first width 112 along the Y direction. The width 112 is formed, for example, on the two transverse sides 110, 111. Along the X direction, the ventilation slot 106 has a second width 113. For example, the second width 113 is formed along the longitudinal sides 108, 109. For example, the extent 120 is less than the length 122 by twice the amount of the second width 113 or approximately twice the amount of the second width 113. For example, the extent 119 is less than the length 121 by twice the amount of the width 112 or approximately twice the amount of the width 112.

According to embodiments, the first width 112 and the second width 113 have the same value so that the cover 104 is spaced from the mounting frame 103 along the longitudinal sides 108, 109 by the same distance as along the transverse sides 110, 111.

According to further embodiments, the width 112 is greater than the width 113. The cover 104 is spaced further from the mounting frame 103 along the transverse sides 110, 111 than along the longitudinal sides 108, 109. Thus, sufficient heat dissipation by means of the air flow 107 is possible, in particular along the Y-direction. In particular, at the upper transverse side 110, sufficient heat can escape from the interior of the mounting device 101 through the ventilation slot 106 having a width 112.

Figure 2:
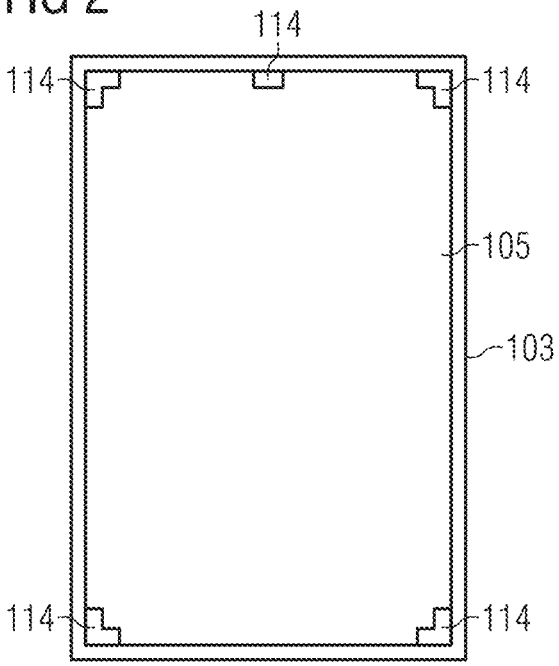

FIG. 2 shows a schematic representation of the mounting frame 103 according to an embodiment example. In the illustrated embodiment example, the mounting frame 103 has five mounting projections 114. A number of mounting projections is also possible, in particular less than five mounting projections or more than five mounting projections. The mounting projections 114 are configured to form a contact surface for the cover 104. Between the mounting protrusions 114, the mounting frame 103 is formed recessed to allow air flow 107 between the mounting protrusions 104.

FIG. 3 shows a schematic representation of the mounting frame 103 with a water installation 200 according to an embodiment. The water installation 200 comprises a water station 102. The water station comprises, for example, a fresh water station. The water station alternatively or additionally comprises, for example, a residential transfer station. The water station alternatively or additionally comprises, for example, a decentralized drinking water heating station. In the following, the water installation 200 is explained in more detail using the example of a fresh water station 102. Features, advantages and designs also apply correspondingly to other water stations, such as an apartment transfer station or a drinking water heating station.

The fresh water station 102 is arranged within the mounting frame 103. As shown in FIG. 3, according to embodiment examples, the water installation 200 also has other elements, such as the heating manifold 115, which is connected to an underfloor heating system, for example.

According to further embodiments, only the fresh water station 102 is provided in the mounting device 101 and no heating manifold 115 or other further elements are provided.

The fresh water station 102 includes a cold water side 116 and a hot water side 117. For example, the cold water side 116 and the hot water side 117 are arranged adjacent to each other along the X direction. Heat generated at the hot water side 117 during operation, for example during a heating of domestic water by means of a heat exchanger, is removed from the interior of the mounting device 101 by means of the air flow 107 through the ventilation slot 106 past the mounting protrusions 114. Thus, the cold water side 116 is not heated undesirably and can in particular be maintained at a temperature of, for example, less than 25° C. water temperature. Thus, for example, legionella formation is avoided and comfort is increased since water is not heated undesirably on the cold water side 116.

In the illustrated embodiment of the water installation 200 with the heating manifold 115, it is possible that insulation is provided along the Y-direction between the fresh water station 102 and the heating manifold 115, in particular to thermally insulate the cold water side 116 from the heating manifold 115. The insulation is designed in such a way that nevertheless a sufficient air flow 107 remains possible through the ventilation slot 106, in particular to dissipate heat from the hot water side 117 at the fresh water station 102.

Figure 4:
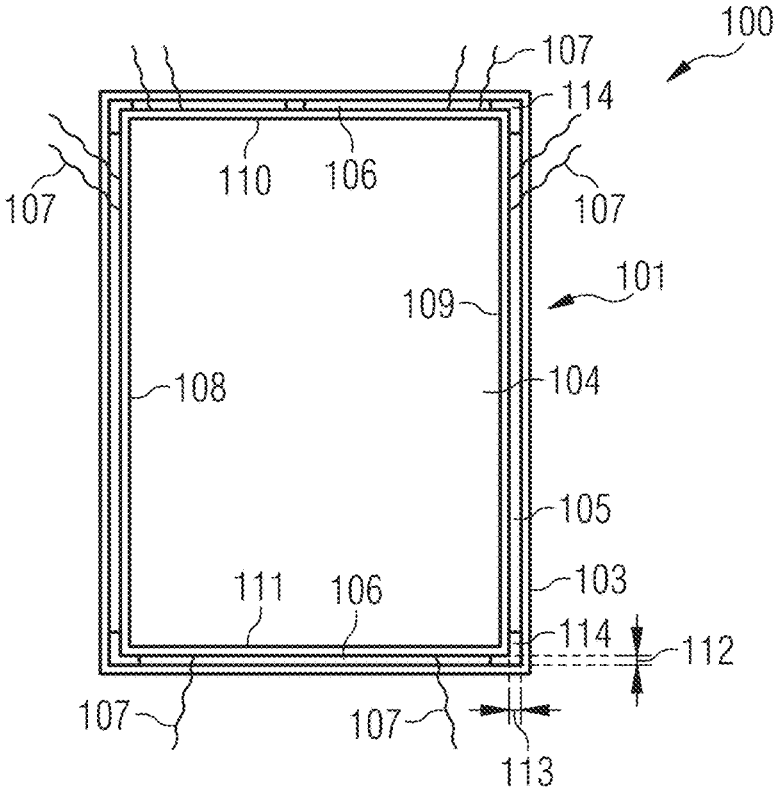

FIG. 4 shows a schematic representation of an installation arrangement 100 with the mounting device 101. Inside the mounting device 101, for example, the water installation 200 is arranged, as shown in FIG. 3. The ventilation slots 106 on the longitudinal sides 108, 109 and the transverse sides 110, 111 of the cover 104 allow air to enter and exit by means of the air flow 107, so that heated air can exit the interior of the mounting device 101 and colder air can enter the interior of the mounting device 101.

In operation, only the hot water side 117 heats up and other predetermined areas, such as the cold water side 116, are protected from an undesirably large amount of heating.

The ventilation slot 106 is sufficient to carry out sufficient waste heat. Thus, the cover 104 can be formed without additional recesses for ventilation. This allows for a uniform appearance of the installation arrangement 100.

According to further embodiments, the installation arrangement 100 or the mounting device 101 comprises the ventilation slot 106 only at the transverse sides 110, 111. At the longitudinal sides 108, 109 of the cover 104, for example, the cover 104 is in contact with the mounting frame 103. It is also possible that the ventilation slot 106 is formed only at the longitudinal sides 108, 109 and the cover 104 is in contact with the mounting frame 103 at the transverse sides 110, 111.

The width 112 and the second width 113 are, for example, between 1 mm and 15 mm wide, in particular between 1 mm and 10 mm, for example between 3 mm and 7 mm. Other dimensions are also possible, depending in particular on the water installation 200 and, for example, other specifications such as hygiene specifications.

The efficient passive dissipation of heat enables reliable operation without incurring large additional costs. For example, existing components can continue to be used and only elements on the mounting frame 103 can be removed so that the recessed areas are formed outside the mounting protrusions 114. In this way, the cold water side 116 in particular is protected from undesirable excessive heating during operation.

REFERENCE SIGNS

100 Installation arrangement
101 Mounting device
102 Fresh water station
103 Mounting frame
104 Cover
105 Opening
106 Ventilation slot
107 Air flow
108, 109 Long sides
110, 111 Cross pages
112, 113 Width
114 Mounting protrusions
115 Heating manifold
116 Cold water side
117 Hot water side
118 Wall
119 Extension
120 Extension
121 Length
122 Length
200 Water installation
x, y direction

The invention claimed is:

1. A mounting device for a water station, comprising:
a mounting frame for attachment to a wall surrounding an opening; and
a cover for closing the opening,
wherein a length of the cover in a Y-direction is shorter than a length of the mounting frame in the Y-direction;
wherein a ventilation slot is formed between the mounting frame and at least one of a transverse side of the cover and a longitudinal side of the cover in a closed state for an air flow between the cover and the mounting frame, and the ventilation slot has a varying width along a perimeter of the cover while the cover is in the closed state,
wherein a portion of the ventilation slot between the two longitudinal sides of the cover and the mounting frame forms longitudinal slots and a portion of the ventilation slot between the two transverse sides of the cover and the mounting frame forms transverse slots, and
wherein the transverse slots formed between the transverse sides of the cover and the mounting frame are wider than the longitudinal slots formed between the longitudinal side of the cover and the mounting frame.

2. The mounting device according to claim 1, wherein the cover has two longitudinal sides and two transverse sides, and the ventilation slot is formed between the two longitudinal sides of the cover and the mounting frame and between the two transverse sides of the cover and the mounting frame.

3. The mounting device according to claim 1, wherein the mounting frame comprises at least a first mounting projection and a second mounting projection, the cover being attachable to the mounting frame at the mounting projections, wherein the ventilation slot is formed between the mounting projections.

4. The mounting device according to claim 1, wherein the cover is free of ventilation slots.

5. An installation arrangement for a water installation, comprising:
the mounting device according to claim 1; and the water station arranged in the mounting device and coverable by means of the cover so that, in operation, heat from the water station can be removed from the mounting device with the air flow.

6. The installation arrangement of claim 5, wherein the water station has a cold water side and a hot water side, the ventilation slot being configured such that, in use, heat is removed with the air flow from the hot water side and conducted away from the cold water side.

7. The installation arrangement according to claim 5, wherein the water station comprises at least one of: a fresh water station, a residential transfer station; and a decentralized domestic water heating station.

8. The mounting device according to claim 1, wherein a length of the cover in an X-direction is shorter than a length of the mounting frame in the X-direction.

9. The mounting device according to claim 1, wherein the mounting frame is free of ventilation slots.

10. The mounting device according to claim 1, wherein the wider transverse slots allows air flow at top and bottom locations of the mounting device to be greater than air flow at left and right locations of the mounting device, resulting in greater heat dissipation at the top and bottom locations of the mounting device as opposed to the left and right locations of the mounting device.

* * * * *